United States Patent [19]

Koyama et al.

[11] 4,304,850

[45] Dec. 8, 1981

[54] PHOTOGRAPHIC ELEMENT FOR COLOR DIFFUSION TRANSFER PROCESS

[75] Inventors: Mikio Koyama; Satoru Ikeuchi; Noboru Mizukura; Hideaki Iwama, all of Hino, Japan

[73] Assignee: Konishiroku Photo Industry Co., Ltd., Tokyo, Japan

[21] Appl. No.: 165,060

[22] Filed: Jul. 1, 1980

[30] Foreign Application Priority Data

Jul. 3, 1979 [JP] Japan ..... 54-84182

[51] Int. Cl.[3] ..... G03C 5/54; G03C 1/40; G03C 5/24

[52] U.S. Cl. ..... 430/463; 430/215; 430/644; 428/519; 428/521

[58] Field of Search ..... 430/214, 215, 216, 644, 430/463; 428/521, 519

[56] References Cited

U.S. PATENT DOCUMENTS

| | | | |
|---|---|---|---|
| 3,958,995 | 5/1976 | Campbell et al. | 430/213 |
| 4,061,496 | 12/1977 | Hannie et al. | 430/215 |
| 4,138,260 | 2/1979 | Krafft | 430/216 |

*Primary Examiner*—Richard L. Schilling
*Attorney, Agent, or Firm*—Bierman & Bierman

[57] ABSTRACT

A photographic element for color diffusion transfer which includes a timing layer comprising a polymeric latex made up of (1) a conjugated diene monomer, (2) and ethylenically unsaturated acid monomer or salt, and (3) an ethylenically unsaturated monomer, which monomers are within certain percentage ranges.

11 Claims, No Drawings

PHOTOGRAPHIC ELEMENT FOR COLOR DIFFUSION TRANSFER PROCESS

This Application claims the priority of Japanese Application 84,182/79, filed July 3, 1979.

The present invention relates to a photographic element for color diffusion transfer process having a timing layer, and more particularly, to a photographic element comprising a timing layer containing a novel polymer latex, which photographic element having enhanced processing temperature latitude.

BACKGROUND OF THE INVENTION

In a color diffusion transfer process, upon the imagewise exposure of a photosensitive silver halide emulsion layer, which has been associated therewith a dye image forming substance, a latent image is formed in the emulsion and is then developed by the application of an alkaline processing composition to form as the function of said development an imagewise distribution of diffusible dye or dyes or the precursors thereof. At least a portion of said distribution is thereafter diffused and transferred onto an image receiving layer, thus to form a dye image thereon.

In such color diffusion transfer processes, it is known to incorporate neutralizing layers in order to stop the excess development and/or diffusion transfer of the diffusible dye or the precursor thereof, and to stabilize the resulting dye image. It is also known to employ various types of timing layer together with such neutralizing layer in order to timely regulate the lowering of pH by the neutralizing layers.

The color diffusion transfer process is generally employed in the so-called instant photography in which processing is carried out at various temperatures. When such processing is effected at temperatures excessively lower than the room temperature, delay of the development reaction, which is considerably affected by the temperature, is brought about, and pH of the processing composition is lowered prior to the completion of predetermined development, resulting in a decrease in the maximum density or an increase in the minimum density, which obstructs the desirable dye image formation. On the contrary, in the case where processing is carried out at temperatures higher than the room temperature, because of development reaction being accelerated the lowering of pH of the processing composition is relatively delayed with the result that excess development of the silver halide emulsion takes place. In order to eliminate this defects some attempts have been heretofore made as disclosed in Japanese Patent Pre-examined Publication No. 53-72622/1978 and U.S. Pat. No. 4,061,496 by the use of a certain kind of timing layer in which permeability of an alkaline solution can be well dependent on the temperature, that is, in such a timing layer the alkaline solution is rendered more permeability at higher temperatures and less alkali permeability at lower temperatures.

However, these heretofore known timing layers have still such drawbacks that their temperature dependency is not necessarily insufficient, i.e., in the case where such timing layer can render the alkaline solution appropriate permeability at lower temperatures, relatively less permeability is given at higher temperatures, or on the contrary, when appropriate permeability is given to the alkaline solution by the timing layer at higher temperatures, the permeability thereof at lower temperatures tends to be insufficient, that the alkali permeability of such timing layers tends to change with the lapse of time or that on manufacturing polymers used for such timing layers materials harmful to the human body often have to be used. Thus few timing layers have been found to be satisfactory.

Accordingly the primary object of the present invention is to provide a photographic element for color diffusion transfer process having an excellent timing layer free of such drawbacks.

SUMMARY OF THE INVENTION

The present invention relates to a photographic element for color diffusion transfer process, which element comprises a support and thereon, as essential layers, a neutralizing layer and a timing layer in this order, wherein said timing layer comprises a polymeric latex represented by the general formula [I];

$$+A+_x+B+_y+C+_z \qquad [I]$$

wherein A represents a copolymerizable conjugated diene monomer unit, B represents a copolymerizable monomer unit of ethylenically unsaturated acid or a salt thereof, C represents a copolymerizable ethylenically unsaturated monomer unit, x, y and z individually represent a proportion contained in said polymer latex in terms of percentage by weight, and x is from about 55 to about 99.5%, y is from about 0.5 to about 44.5%, and z is from 0 to about 44.5%.

DESCRIPTION OF THE PREFERRED EMBODIMENTS

The preferred ethylenically conjugated diene monomer unit represented by A of the formula [I] has the following general formula [II];

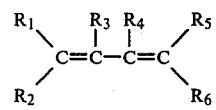

[II]

wherein $R^1$ to $R^6$ independently represents a hydrogen atom or a halogen atom, or an alkyl, aryl, cyano, or —$COOR_7$ group wherein $R_7$ represents an alkyl group.

The preferred halogen atom is chlorine or bromine.

The preferable alkyl group represented by $R_1$ through $R_7$ is a lower alkyl group, particularly that having 1 to 4 carbon atoms and most preferably a methyl group. The alkyl group represented by $R_1$ to $R_7$ may have a substituent, but, preferably it is not substituted. As the aryl group represented by $R_1$ to $R_6$, phenyl group which may optionally be substituted, preferably, by such atom or group as a halogen (preferably, chlorine or bromine) or an alkyl (preferably that having 1 to 3 carbon atoms, and especially methyl) can be mentioned.

Among these hydrogen, halogen or alkyl is most preferable.

The total number of carbon atoms contained in the monomer unit of the formula [II] is preferably 4 to 12, more preferably, 4 to 9, and most preferably, 4 to 6. And it is preferable for at least two of $R_1$ to $R_6$ to be a hydrogen atom.

Examples of such monomers include 1,3-butadiene; alkyl (preferably lower alkyl having 1 to 4 carbon atoms) substituted 1,3-butadiene (e.g., isoprene; 1,3-pentadiene; 2-ethyl-1,3-butadiene; 2-n-propyl-1,3-butadiene; 2-n-butyl-1,3-butadiene; 2,3-dimethyl-1,3-butadiene; 2-methyl-1,3-pentadiene; 4-methyl-1,3-pentadiene); aryl (preferably phenyl) substituted 1,3-butadiene (e.g., 1-phenyl-1,3-butadiene; 2-phenyl-1,3-butadiene; 1-(p-chlorophenyl)-1,3-butadiene; 1-phenyl-2-carbomethoxy-1,3-butadiene; 2-p-tolyl-1,3-butadiene); halogen (preferably chlorine or bromine) substituted 1,3-butadiene (e.g., 1-chloro-1,3-butadiene; 2-chloro-1,3-butadiene; 1-bromo-1,3-butadiene; 2-bromo-1,3-butadiene; 1,1-dichloro-1,3-butadiene; 2,3-dichloro-1,3-butadiene; 2,3-dibromo-1,3-butadiene; 1,1,2-trichloro-1,3-butadiene; 1,1,2,3-tetrachloro-1,3-butadiene); cyano substituted 1,3-butadiene (e.g., 1-cyano-1,3-butadiene; 2-cyano-1,3-butadiene).

Of these conjugated diene compounds the preferred ones are 1,3-butadiene, alkyl (preferably methyl) or halogen substituted 1,3-butadiene, more preferably 1,3-butadiene, isoprene or 2,3-dimethyl-1,3-butadiene; and the most preferred is isoprene or 2,3-dimethyl-1,3-butadiene.

The preferred copolymerizable unit of ethylenically unsaturated acid or the salts thereof represented by B of the formula [I] is one having at least one, preferably, one or two carboxyl groups, sulfo groups or an alkali metallic salt thereof, preferably, the monomer represented by the formula [III];

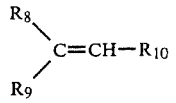

[III]

wherein $R_8$ represents carboxyl group, sulfo group or an alkali metallic salts thereof, or a group having carboxyl group, sulfo group, or an alkali metallic salt thereof, $R_9$ represents a hydrogen atom or alkyl group, and $R_{10}$ represents a hydrogen or alkoxycarbonyl group.

As preferred alkali metallic salt for $R_8$ a sodium salt or potassium salt can be mentioned. As the preferred group for $R_8$ having carbonyl group, sulfo group or the alkali metallic salt thereof, sulfophenyl group, sulfoalkyloxycarbonyl group wherein the alkyl group has preferably 1 to 4 carbon atoms, sulfoalkylcarbamoyl group wherein the alkyl group has preferably 1 to 5 carbon atoms.

The alkyl group for $R_9$ may have a substituent which may be preferably alkoxycarbonyl group or carboxyl group. The preferred alkyl group includes methyl group, alkoxycarbonyl methyl group containing alkoxyl group having 1 to 4 carbon atoms, and carboxymethyl group.

The alkoxycarbonyl group represented by $R_{10}$ should preferably be one containing 2 to 5 carbon atoms.

More specifically the preferable monomer unit represented by the formula [III] includes, for example, acrylic acid, methacrylic acid, itaconic acid, itaconic acid monoalkyl ester (preferably, alkyl ester containing alkyl having 1 to 4 carbon atoms, e.g., monomethyl itaconate and monobutyl itaconate), maleic acid monoester (preferably, alkyl ester containing 1 to 4 carbon atoms, e.g., monoethyl maleate, monobutyl maleate) and an alkali metallic salt thereof. And the copolymerizable ethylenically unsaturated sulfonic acid includes, styrene sulfonic acid, acryloyloxyalkyl sulfonic acid (e.g., acryloyloxypropyl sulfonic acid and acryloyloxyethyl sulfonic acid), methacryloyloxyalkyl sulfonic acid (e.g., methacryloyloxypropyl sulfonic acid and methacryloyloxybutyl sulfonic acid), acrylamido alkyl sulfonic acid (e.g., 2-acrylamido-2-methylethane sulfonic acid and 2-acrylamido-2-methylbutane sulfonic acid), methacrylamido alkyl sulfonic acid (e.g., 2-methacrylamide-2-methylethane sulfonic acid) and an alkali metallic salt thereof.

Among them more preferable one includes one having one or two carboxyl groups, e.g., acrylic acid, methacrylic acid, itaconic acid, maleic acid monomethyl ester, etc., particularly, acrylic acid, methacrylic acid, and itaconic acid, and the most preferred one is acrylic acid.

Other preferable monomer unit as B includes one having at least one, phosphono group or a salt thereof. More specifically it includes a monomer represented by the formula [IV];

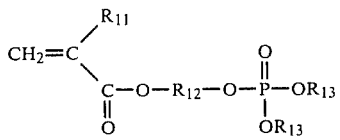

[IV]

wherein $R_{11}$ is a hydrogen atom or methyl group, $R_{12}$ is an aliphatic hydrocarbon group having 2 to 10 carbon atoms or a group $+R_{14}—O+_mR_{14}—$ wherein $R_{14}$ is an aliphatic hydrocarbon group having 2 to 6 carbon atoms, $R_{13}$ is hydrogen, alkali metal or $—NH_4$ and m is an integer 1 to 5.

The aliphatic hydrocarbon group represented by $R_{12}$ or $R_{13}$ is preferably an alkylene group which may be a straight chain or a branched chain and may be substituted by, for example, halogen such as chlorine, lower alkoxy such as methoxy, ethoxy, or aryl such as phenyl. Preferable example of the monomer unit which is represented by the formula [IV] includes 2-acryloyloxyethylphosphate, 1-methyl-2-acryloyloxyethylphosphate, 2-acryloyloxyethoxylethylphosphate, 4-acryloyloxybutylphosphate, 2-methacryloyloxyethylphosphate, 1-methyl-2-methacryloyloxyethylphosphate, 1-chloromethyl-2-methacryloyloxyethylphosphate, 2-methacryloyloxyethoxyethylphosphate, 4-methacryloyloxybutylphosphate. And the most preferable ones are 2-methacryloyloxyethylphosphate and 2-acryloyloxyethylphosphate.

The preferred copolymerizable ethylenically unsaturated monomer unit represented by C of the formula [I] include copolymerizable ethylenically unsaturated nitriles, styrenes, acrylic acid esters, methacrylic acid esters, acrylamides, methacrylamides, vinyl heterocyclic compounds, and cross linking monomers.

The copolymerizable ethylenically unsaturated nitrile includes, for example, acrylonitrile, methacrylonitrile, α-chloroacrylonitrile.

The styrenes include, for example, styrene, p-methylstyrene, α-methylstyrene, p-chlorostyrene, and chloromethyl styrene.

The acrylic acid esters include, for example, methyl acrylate, ethyl acrylate, n-butyl acrylate, n-propyl acrylate, isobutyl acrylate, sec-butyl acrylate, 2-hydroxylethyl acrylate, and 2-hydroxypropyl acrylate.

The methacrylic acid esters include, for example, methyl methacrylate, ethyl methacrylate, n-butyl methacrylate, 2-hydroxyethyl methacrylate, and 2-hydroxypropyl methacrylate.

The acrylamides include, e.g., acrylamide, diacetoneacrylamide, methylolacrylamide, methylacrylamide.

The methacrylamides include, e.g., methacrylamide, benzylmethacrylamide.

The vinyl heterocyclic compounds include, e.g., N-vinylpyrrolidone, N-vinylimidazol, vinylpyridines (e.g., 4-vinylpyridine, 2-vinylpyridine, etc.).

The cross-linkable monomers include, e.g., divinyl benzene, ethyleneglycol dimethacrylate, trimethylopropane triacrylate, pentaerythrit trimethacrylate.

Among those monomers above the most preferred ones are copolymerizable ethylenically unsaturated nitriles (particularly, acrylonitrile and methacrylonitrile), styrenes (especially styrene), acrylic acid esters (particularly lower alkyl esters containing alkyl having 1 to 4 carbon atoms, e.g., ethyl acrylate, 2-hydroxyethyl acrylate, and n-butyl acrylate), methacrylic acid esters (particularly lower alkyl ester of 1 to 4 carbon atoms, e.g., ethyl methacrylate), and of them the most preferred one is acrylonitrile.

The "x" in terms of weight percent is from about 55 to about 99.5, preferably, from about 55 to about 80, and more preferably, from about 60 to about 80.

The "y" in terms of weight percent is from about 0.5 to about 44.5, preferably, from about 2 to about 10, and more preferably, from about 2 to about 8.

Similarly, "z" is from zero to about 44.5, preferably, from about 15 to about 40.

In the foregoing polymer latex represented by the formula [I], the respective monomer units A, B, and C each may consist of two or more kinds.

The examples of the polymer latices used in the present invention are given below:

| Exemplified compounds: | |
|---|---|
| (1) 1,3-butadiene/styrene/itaconic acid copolymer | (70:25:5) |
| (2) 1,3-butadiene/methyl acrylate/acrylic acid copolymer | (60:37:3) |
| (3) 1,3-butadiene/acrylonitrile/methacrylic acid copolymer | (65:33:2) |
| (4) 1,3-butadiene/methyl methacrylate/2-methacrylamide-2-methylethanesulfonic acid copolymer | (60:30:10) |
| (5) 1,3-butadiene/n-butylacrylate/monomethyl maleate copolymer | (55:40:5) |
| (6) Isoprene/acrylonitrile/acrylic acid copolymer | (60:38:2) |
| (7) Isoprene/methacrylonitrile/methacrylic acid copolymer | (65:32:3) |
| (8) Isoprene/butadiene/styrene/acrylic acid copolymer | (50:30:15:5) |
| (9) Isoprene/2,3-dimethyl-1,3-butadiene/acrylonitrile/acrylic acid copolymer | (40:30:25:5) |
| (10) Isoprene/acrylonitrile/divinylbenzene/acrylic acid copolymer | (60:37:0.5:2.5) |
| (11) Isoprene/acrylonitrile/N-vinylpyrrolidone/acrylic acid copolymer | (75:20:3:2) |
| (12) Isoprene/methyl acrylate/methacrylic acid copolymer | (65:31:4) |
| (13) 2,3-dimethyl-1,3-butadiene/acrylonitrile/acrylic acid copolymer | (70:25:5) |
| (14) 2,3-dimethyl-1,3-butadiene/acrylonitrile/acrylic acid copolymer | (75:19:6) |
| (15) 2,3-dimethyl-1,3-butadiene/methyl methacrylate/acrylic acid copolymer | (75:19:6) |
| (16) Chloroprene/p-methylstyrene/itaconic acid copolymer | (65:27:8) |
| (17) Chloroprene/n-butyl acrylate/2-hydroxyethyl methacrylate/methacrylic acid copolymer | (75:15:5:5) |
| (18) Chloroprene/acrylonitrile/acrylic acid copolymer | (65:30:5) |
| (19) 2-bromo-1,3-butadiene/styrene/itaconic acid copolymer | (75:17:8) |
| (20) 2-bromo-1,3-butadiene/acrylonitrile/acrylic acid copolymer | (60:32:8) |
| (21) 2-bromo-1,3-butadiene/n-butyl acrylate/monomethyl maleate copolymer | (65:32:3) |
| (22) 2,3-dimethyl-1,3-butadiene/isoprene/acrylonitrile/acrylic acid copolymer | (30:30:36:4) |
| (23) 1,3-butadiene/n-butyl acrylate/acrylic acid | (80:15:5) |
| (24) 2,3-dimethyl-1,3-butadiene/methyl acrylate/2-acryloyloxyethylphosphate | (60:36:4) |
| (25) Isoprene/acrylonitrile/2-acryloyloxyethylphosphate | (75:19:6) |
| (26) 2,3-dimethyl-1,3-butadiene/acrylonitrile/2-methacryloyloxyethylphosphate | (75:19:6) |

The polymer latices used in a photographic element of the present invention may be produced by, for example, stirring at the speed of 150 to 300 rpm. at a temperature from 30° to 60° C. for 5 to 8 hours in a nitrogen gas-replaced reactor the mixture of water, surfactant (e.g., Trux H-45, manufactured by Nippon Yushi Co.), the respective monomers, potassium persulfate, and sodium metabisulfite.

SYNTHESIS EXAMPLE 1

(The synthesis of exemplified compound (1))
[1,3-butadiene/styrene/itaconic acid copolymer (70:25:5)]

200 ml of deaired water, 7.2 ml of Trux H-45 (the name of the surfactant product manufactured by Nippon Yushi Co.; available constituent 30%), 3.0 g of itaconic acid, 21 g of styrene, 0.498 g of potassium persulfate, and 0.35 g of sodium metabisulfite were prepared in a glass autoclave for the capacity of 500 ml, which was closed up and then whose inside air was replaced by nitrogen gas.

42.0 g of 1,3-butadiene was conducted into the autoclave, and then the inside pressure was raised by additional nitrogen gas up to 5 kg/cm$^2$. Keeping the stirring revolution speed at 300 rpm., the inside temperature was raised up to 60° C., and polymerization was carried out over the period of five hours under said condition. After the completion of the reaction, the inside temperature was lowered to the level of room temperature, the inside pressure also was lowered, and then the reaction product was taken out.

The degree of polymerization—99.7%

Itaconic acid content (by conductometric titration) $3.5\times10^{-4}$ mol/g polymer

SYNTHESIS EXAMPLE 2

(The synthesis of exemplified compound (6))
[Isoprene/acrylonitrile/acrylic acid copolymer (60:38:2)]

200 ml of deaired water, 4 ml of Trux H-45 (the name of the surfactant product manufactured by Nippon Yushi Co.; available constituent 30%), 1.2 g of acrylic acid, 22.8 g of acrylonitrile, and 36 g of isoprene were prepared in a 500 ml four neck flask equipped with a stirrer, thermometer, dry ice condencer, and nitrogen gas conducting pipe. Keeping conducting the small amount of nitrogen gas into the flask, the inside temperature at 30° C. and the stirring at 300 rpm., the solutions of 0.48 g of potassium persulfate and 0.35 g of sodium metabisulfite dissolved in 10 ml and 8 ml of deaired water respectively was added at the same time to the mixture to carry out polymerization reaction for 8 hours at the temperature of 30° C. with stirring at the speed of 300 rpm.

After the completion of the reaction, the resulting mixture was filtered to obtain the reaction product.

The degree of polymerization—98.7%

Acrylic acid content (by conductometric titration) $2.82\times10^{-4}$ mol/g polymer

SYNTHESIS EXAMPLE 3

(The synthesis of exemplified compound (14))
[2,3-dimethyl-1,3-butadiene/acrylonitrile/acrylic acid copolymer (75:19:6)]

200 ml of deaired water, 2 ml of Trux H-45 (the name of the surfactant product manufactured by Nippon Yushi Co.; available constituent 30%), 3.6 g of acrylic acid, 45.0 g of 2,3-dimethyl-1, 3-butadiene, and 11.4 g of acrylonitrile were put in a 500 ml four neck flask equipped with a stirrer, thermometer, condencer, and nitrogen gas conducting pipe. Conducting nitrogen gas into the flask, keeping the inside temperature at 50° C., and stirring at the speed of 300 rpm., the solutions of 0.48 g of potassium persulfate, and 0.35 g of sodium metabisulfite dissolved in 10 ml and 8 ml of deaired water respectively were added to the mixture at the same time to carry out polymerization reaction over the period of 5 hours at 30° C. with stirring at the speed of 300 rpm. After the completion of the reaction, the mixture was filtered to obtain the reaction product.

The degree of polymerization—99.9%

Acrylic acid content (by conductometric titration) $4.17\times10^{-4}$ mol/g polymer The particle size of the polymer latex of the present invention, though not to be limited, is preferred to be normally from 20 to 200 mμ. The coating amount of the polymer latex of the present invention, although variable according to, e.g., the neutralizing layer and processing composition, is preferably from 0.5 g/m$^2$ to 8.0 g/m$^2$, and more preferably from 1.0 g/m$^2$ to 4.0 g/m$^2$.

In coating the timing layer of the present invention, prior to the coating, the amount of less than 5% by weight of various surfactant, e.g., Triton X-100 (likely to be t-octylphenoxypolyethoxyethanol)tetraethyl ammonium heptadecylfluorooctylsulfonate, or organic solvent, e.g., methylcellosolve is preferred to be added to the polymeric latex.

The timing layer of the present invention may be coated in various conventional aqueous coating method. The drying of the coated layer can be made in the extensive temperature range, preferably, in the range from 50° C. to 95° C. with the time range from 30 seconds to 5 minutes, preferably, from 30 seconds to 2 minutes.

For the neutralizing layer of the present invention, any material capable of lowering the pH of the image receiving layer after the transfer image formation may be used, so that such various conventionally known materials (e.g., polymeric acid layer) may be employed. The action of such neutralizing layer stops the development subsequent to the substantial image formation to prevent the subsequent transfer of excessive diffusible dye, and also to increase the stability of the transferred image.

To the support of the photographic element of the present invention, any conventionally known support material for photographic materials is applicable which may be either transparent or opaque according to purposes.

The photographic element of the present invention may have a second timing layer interposed between said neutralizing layer and said timing layer. This second timing layer preferably consists of a material of which activation energy of penetration of an aqueous alkaline solution is less than 18 Kcal/mol. As such a material, for example a mixture of acetylcellulose and maleic anhydride copolymer (preferred mixture ratio: from 95 to 5 to 50 to 50 by weight), polyvinyl acetate, cellulose acetate phthalate, polymer latex of butyl acrylate/-diacetoneacrylamide/styrene/methacrylic acid, and the mixture of polyvinyl acetate and polyvinylalcohol. The most preferred one of them is the mixture of acetylcellulose and maleic anhydride copolymer, above all, the mixture of acetylcellulose having acetyl content ranging from 35 to 40% by weight and poly(styrene-co-maleic anhydride), poly(ethylene-co-maleic anhydride), or poly(methylvinylether-co-maleic anhydride). The coating amount of the second timing layer is preferred to be from 1 to 8 g/m$^2$, more preferably, from 2 to 5 g/m$^2$. Although an interlayer is allowed to be used between the second timing layer and the timing layer of the present invention, these two timing layers are desired to be adjacent to each other. And, the timing layer of this invention may be provided coated thereon with an alkali permeable, hydrophilic layer, which is particularly preferred to be provided for the photographic element of the second type hereinafter described.

Materials applicable to such alkali-permeable hydrophilic layer include, e.g., gelatin, polyvinylalcohol, ethyl methacrylate—methacrylic acid copolymer, methyl methacrylate—methacrylic acid copolymer, methylvinylether—maleic anhydride copolymer, casein, carboxymethylcellulose, cellulose acetate phthalate, hydroxyethylcellulose, etc. The most preferred one of them is gelatin. These alkali-permeable hydrophilic layer may optionally be hardened or cross-linked.

In the photographic element of the present invention, if necessary, an adhesion layer may be provided directly or through the foregoing alkali-permeable hydrophilic layer on the timing layer of this invention. The adhesion layer is to be effectively used for adhering the spacer rail to regulate the thickness of the alkaline processing composition to the photographic element of the present invention.

For such adhesion layer, some alkali-permeable layer is preferred containing, e.g., substantially not coalesceable, arylonitrile—vinylidene chloride—acrylic acid copolymer.

The photographic element of the present invention, as is described in the scope of the claim thereof, may be any one that has, in order, a neutralizing layer and a timing layer as essential layers coated on a support, which includes as described below:

I-(1)

A photographic element, normally called "processing sheet", having coated on its support, in order, a neutralizing layer and the timing layer of the present invention as essential layers, which is advantageously utilized, in color diffusion transfer process, together with a photosensitive element having a photosensitive silver halide emulsion layer associated therewith a dye image forming material and an image receiving layer.

I-(2)

A photographic element having between the two support thereof, in order, a neutralizing layer, the timing layer of the present invention, a photosensitive silver halide emulsion layer associated therewith a dye image forming material and an image receiving layer as essential layers, and an alkaline processing composition to be spread between said timing layer and said silver halide emulsion layer.

I-(3)

A photographic element having between the two supports thereof, in order, a neutralizing layer, the timing layer of the present invention, a photosensitive silver halide emulsion layer associated therewith a dye image forming material and an image receiving layer as essential layers, and further having means which contains alkaline processing composition to be discharged between said timing layer and said silver halide emulsion layer.

II-(1)

A photographic element, normally called "image receiving element", having coated on the support thereof, in order, a neutralizing layer, the timing layer of the present invention and an image receiving layer as essential layers, and advantageously used, in color diffusion transfer process, together with, e.g., a photosensitive element having coated on its support a photosensitive silver halide emulsion layer associated therewith a dye image forming material.

II-(2)

A photographic element having between the two supports thereof, in order, a neutralizing layer, the timing layer of the present invention, an image receiving layer and a photosensitive silver halide layer associated therewith a dye image forming material as essential layers, and an alkaline processing composition to be discharged between said image receiving layer and said silver halide emulsion layer.

II-(3)

A photographic element having between the two supports thereof, in order, a neutralizing layer, the timing layer of the present invention, an image receiving layer, and photosensitive silver halide emulsion layer associated therewith a dye image forming material as essential layers, and also having means containing alkaline processing composition to be discharged between said image receiving layer and said silver halide emulsion layer.

In the present invention, the photographic element, as shown in the above I-(2) and II-(2), having between the two supports thereof, as essential layers, a neutralizing layer, the timing layer of the present invention, an image receiving layer, and a photosensitive silver halide emulsion layer associated therewith a dye image forming material is referred to as a "color diffusion transfer photographic material".

And, the photographic element, as described in the above I-(3) and II-(3), having means containing an alkaline processing composition in addition to said color diffusion transfer photographic material is referred to as a "color diffusion transfer film unit".

In the case of I-(2) and I-(3) wherein a photosensitive silver halide emulsion layer associated therewith a dye image forming material and an image receiving layer are coated on a same support, an opaque layer and/or a light reflective layer, if necessary, may be provided between said photosensitive silver halide emulsion layer and said image receiving layer. These layers are especially desired to be provided in the order of the image receiving layer, light reflection layer, opaque layer and photosensitive silver halide emulsion layer. This light reflective layer is effective as the background of the dye image formed on the image receiving layer, and the opaque layer has a light-tight effect for processing in a bright place the photosensitive silver halide emulsion layer of the photographic material to which is applied the photographic element of the present invention.

Further, in the photographic element of the present invention, if necessary, a stripping layer may be provided, preferably, between the foregoing photosensitive silver halide emulsion layer and image receiving layer. The stripping layer, after the substantial dye image formation, enables in its position peeling apart said silver halide emulsion layer and said image receiving layer.

To the photographic element of the present invention, if necessary, various additives may be added. Particularly, it is preferable to add a development restrainer or development restrainer precursor to the timing layer of the present invention and/or the second timing layer, more preferably, to add a development restrainer precursor to the second timing layer.

In such forms of the photographic element as in I-(1), I-(2), I-(3) and II-(1), the support is preferred to be transparent, and in such forms of the photographic element as in II-(2) and II-(3), the support disposed on the side of the neutralizing layer in reference to the image receiving layer is preferred to be transparent, while the other support on the side of the photosensitive silver halide emulsion layer in reference to the image receiving layer is preferred to be opaque. The most preferred forms of the photographic element of the present invention are I-(1), I-(2), and I-(3).

To obtain a multicolor image using the above-mentioned color diffusion transfer photographic material or the film unit, the use of two or more units of the combination of the photosensitive silver halide emulsion layer associated therewith the dye image forming material is preferred. If there exists a difference in the color sensitivity between the combination units, it is advantageous to apply an interlayer between the combination units, which interlayer serves for the prevention of undesirable interactions arising between the units as well as for controlling the diffusion of diffusible dyes or the precursor thereof or the diffusibility of the alkaline processing composition.

The dye image forming material should be positioned so that it will not reduce the speed of the photosensitive silver halide emulsion which is associated therewith; i.e., when the wavelength absorption region of the dye image forming material is overlapped with the photosensitive wavelength region of the photosensitive silver halide emulsion, the dye image forming material is desired to be incorporated in the layer on the opposite side of the photosensitive silver halide emulsion layer to the exposure direction. On the contrary, such materials as a dye image forming material not having any dye structure at the time of exposure, a dye image forming material having dyes of the leuco type, and a color image forming material having dyes of the short wavelength shift type may be incorporated into the photosensitive silver halide emulsion layer because these dye image forming materials do not reduce the sensitivity of the emulsion, and also may be incorporated in the layer located in the exposure direction of the emulsion layer.

The color diffusion transfer photographic material preferable for obtaining a multicolor image has between the two supports thereof, in order, as essential layers, an image receiving layer, light reflective layer, opaque layer, cyan dye image forming material layer, red-sensitive silver halide emulsion layer, interlayer, magenta dye image forming material layer, green-sensitive silver halide emulsion layer, interlayer, yellow dye image forming material layer, blue-sensitive silver halide emulsion layer, protective layer, the timing layer of the present invention, second timing layer, and neutralizing layer.

Thus prepared color diffusion transfer photographic material can be processed in a bright place by distributing after exposure an alkaline processing composition containing an opaque substance between said protective layer and the timing layer of the present invention. And upon the substantial dye image formation on the image receiving layer, the image receiving layer and the emulsion layer may be peeled apart.

Various conventionally known materials may be used for the afore-said image receiving layer, protective layer, interlayer, stripping layer, light reflective layer, and opaque layer.

As the dye image forming material, either non-diffusible or diffusible, conventionally known materials among alkaline media may be used.

As a non-diffusible dye image forming material in alkaline media, there are dye releasing redox compounds such as disclosed in U.S. Pat. Nos. 4,076,529 and 3,443,939, French Pat. No. 2,284,140, Japanese Patent Pre-examined Publications Nos. 53-46730/1978, 53-50736/1978, 51-113624/1976, and 53-3819/1978; non-diffusible dye image forming materials such as disclosed in for example Japanese Patent Pre-examined Publications Nos. 49-111628/1974 and 51-63618/1976 which, although capable of releasing diffusible dyes in such alkaline media as, is lowered in said diffusible dye releasing rate when reacted with the oxidized product of the silver halide developing agent; the so-called BEND compounds such as, e.g., in Japanese Patent Pre-examined Publications Nos. 53-110827/1978 and 53-110828/1978; and diffusible dye releasing type couplers such as, e.g., in U.S. Pat. No. 3,227,550.

As substantially diffusible color image forming materials in alkali media, there are dye developers such as, e.g., disclosed in U.S. Pat. Nos. 2,983,606, 3,880,658, 3,854,945 and 3,563,739.

In the present invention, particularly effective dye image forming materials are dye releasing type redox compounds.

The preferred ones for the present invention among the dye-releasing redox compounds are the non-diffusible sulfonamide type dye releasing redox compounds capable of releasing diffusible dyes or the precursors thereof having sulfamoyl group, of which the more preferred are ones having the formulas [IV], [V], or [VI]:

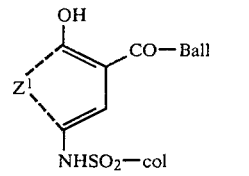

[IV]

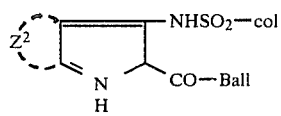

[V]

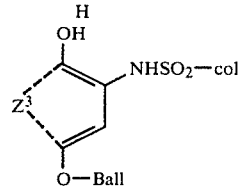

[VI]

wherein Ball represents an organic ballasting group having carbon atoms sufficient to render said compound non-diffusible during development with an alkaline processing composition; $Z^1$ represents carbon atoms necessary to complete a benzene ring or naphthalene ring; $Z^2$ and $Z^3$ represent carbon atoms necessary to complete a benzene ring; the above benzene ring and naphthalene ring may have one or more substituents; and col represents a dye or dye precursor moiety.

As the photosensitive silver halide emulsion layer associate therewith a dye image forming material, if desired, any conventional emulsion of either the negative type or the positive type can be used.

For example, in the case of merely combining a negative type photosensitive silver halide emulsion with a dye image forming material capable of producing a negative type diffusion transfer dye image (e.g., dye releasing type redox compounds) is used, while in obtaining a positive type diffusion transfer dye image, conventionally known various reversal processes may be employed.

For example, in a method using a direct-positive silver halide emulsion such as disclosed in U.S. Pat. Nos. 3,227,552, 2,592,250, 2,005,837, 3,367,778, 3,761,276 British Pat. No. 1,011,062, Japanese Patent Examined Publication No. 41-17184/1966, Japanese Patent Pre-examined Publication No. 50-8524/1975, etc., or in a method using a physical development such as disclosed in British Pat. No. 904,364, Japanese Patent Pre-examined Publication 47-325/1972, etc., in this method a negative type photosensitive silver halide emulsion layer and its adjacent layer containing physical development nucleus are normally used.

As disclosed in Japanese Patent Examined Publication 43-21778/1968, U.S. Pat. Nos. 3,227,554, 3,632,345, etc., there is further a method which uses a fogged silver halide emulsion layer containing a dye image forming material and a negative type photosensitive silver halide emulsion layer containing a compound which can release a development restrainer by the reaction with the oxidized product of a silver halide developing agent.

In the above-mentioned reversal method, the most preferred one for the present invention is the so-called internal latent image type direct-positive silver halide emulsion, particularly, the core-shell type internal latent image direct-positive silver halide emulsion, such as, e.g., described in U.S. Pat. No. 3,761,276.

To use an internal latent image direct-positive silver halide emulsion, it is preferred to incorporate a fogging agent into the photographic material and/or its processing composition. To incorporate a fogging agent into the photographic material, it is preferred to incorporate it into the photosensitive silver halide emulsion layer or the adjacent layer thereto.

The processing composition for processing the foregoing color diffusion transfer photographic material is normally an alkaline processing composition containing alkaline agent which has above about pH 10 at room temperature.

The processing composition preferably contains a viscous agent, and its viscosity should be normally about 100 to about 300,000 centi-pois, with which uniform distribution of the processing composition can be achieved during the processing. Further, during the processing an immobile membrane is formed which even serves for the prevention of undesirable changes in the resulting image upon the substantial dye image formation.

If the dye image forming material itself has no function of developing the silver halide, silver halide developing agents are used.

Even when the dye image forming material itself is capable of developing silver halide, it is desirable to use auxiliary silver halide developing agents. These silver halide developing agents are normally incorporated into the processing composition and/or the processing composition permeable layer of the photographic material. Besides, the processing composition may contain silver halide solvents, etc., depending on silver halide emulsion to be used, and also may contain various additives normally used such as a light reflective agent (e.g., titanium dioxide), opaque material (e.g., carbon black, indicator dye), etc.

As means for applying the processing composition to the color diffusion transfer photographic material, conventional various means may be employed: the preferred form of means for such purpose is a container which is rupturable at the time of processing.

The following examples illustrate further in detail the photographic element of the present invention, but it is needless to say the present invention is not limited thereto.

EXAMPLE 1

The following layers were, in order, coated on a transparent 100μ polyethylene terephthalate support:

(1) Neutralizing layer:

Neutralizing layer with dried thickness of 22μ containing acrylic acid—n-butyl acrylate copolymer (average molecular weight 70,000—the ratio by weight 75:25)

(2) Second timing layer

Second timing layer with dried thickness of 4.4μ the mixture (44 mg/100 cm$^2$) of 95% by weight of cellulose diacetate (acetyl content of 40%) with 5% by weight of styrene—maleic anhydride copolymer (hydrolyzed less than 50%).

The timing layer of the present invention with dried thickness of 2.2μ containing exemplified compounds (1), (2), (6), (9), (10), (13), (14), (15), (16), (22) and (23) (22 mg/100 cm$^2$) was coated on the above-mentioned second timing layer to make the photographic element (processing sheets) (1)–(11).

On the other hand, a control photographic element (control processing sheet) was prepared by coating on the foregoing second timing layer the latex (butadiene-n-butyl acrylate-acrylic acid: the ratio by weight 15:80:5) polymerized in accordance with the description of Japanese Patent Pre-examined Publication 53-72622/1978.

These processing sheets (1)–(11) and control processing sheet were allowed to stand over the period of three days at the temperatures of 55° C. and 50° C. with the humidity of 80%.

The thus treated sheet, untreated sheet, and the control sheet were superposed respectively with a sheet of 100μ transparent polyethylene terephthalate support, and further a readily rupturable pod containing 1 ml of the following composition was attached to between said sheets of each unit to make non-photosensitive film units.

The above film units were then passed between a juxtaposed pressure rollers with a gap of 340μ at the temperatures of 15° C. and 25° C. to spread the processing composition between said processing sheet and said transparent support of each unit.

The composition used here is as follows:

| | |
|---|---|
| Sodium hydroxide | 45 g |
| Carboxymethylcellulose sodium salt | 25 g |
| Thymolphthalein | 1 g |
| Water to make | 1 liter |

After the spreading of the processing composition, measurements were made on the time when the pH indicator thymolphthalein started to discolor and the time when the color completely disappeared. The average time results are shown as discoloration time in table 1.

The activation energy is determined from the Arrhenius' equation:

$$Ea \text{ (activation energy)} = 0.00458 \times \frac{\log Y^2/Y^1}{1/E_2 - 1/T_1}$$

wherein $T_2$: higher temperature $T_1$: lower temperature $Y_2$: the time (minutes) at $T_2$ $Y_1$: the time (minutes) at $T_1$

TABLE 1

| Processing Sheet No. | Treatment Condition: Untreated, Temperatures 15° C. | 25° C. | 35° C. | Activation energy Ea (Kcal/mol) | Treated 55° C. for 3 days, Temperatures 15° C. | 25° C. | 35° C. | Activation energy Ea (Kcal/mol) | Treated 50° C./80% RH for 3 days, Temperature 15° C. | 25° C. | 35° C. | Activation energy Ea (Kcal/mol) |
|---|---|---|---|---|---|---|---|---|---|---|---|---|
| (1) | 16.8 | 4.2 | 1.9 | 23.9 | 18.4 | 4.6 | 2.0 | 23.9 | 20.0 | 5.0 | 2.3 | 23.8 |
| (2) | 26.4 | 5.2 | 2.0 | 28.6 | 25.7 | 5.0 | 2.3 | 28.2 | 28.3 | 5.5 | 2.6 | 28.2 |
| (3) | 22.4 | 4.7 | 2.2 | 26.6 | 21.8 | 4.7 | 2.1 | 26.3 | 24.0 | 4.8 | 2.4 | 27.6 |
| (4) | 12.1 | 4.0 | 1.9 | 18.9 | 16.5 | 4.4 | 2.0 | 22.8 | 17.1 | 4.5 | 2.0 | 22.9 |
| (5) | 18.0 | 5.0 | 2.1 | 21.9 | 20.8 | 5.2 | 2.5 | 23.9 | 22.1 | 5.4 | 2.6 | 24.3 |
| (6) | 20.2 | 4.2 | 1.9 | 27.1 | 24.0 | 4.9 | 2.2 | 27.3 | 28.1 | 5.3 | 2.4 | 28.5 |
| (7) | 21.0 | 3.7 | 2.0 | 29.7 | 28.7 | 5.6 | 2.4 | 27.5 | 25.4 | 5.7 | 2.5 | 25.7 |
| (8) | 18.1 | 4.7 | 2.1 | 23.2 | 26.4 | 5.1 | 2.6 | 28.1 | 28.0 | 6.1 | 3.0 | 26.1 |
| (9) | 12.1 | 3.2 | 2.0 | 22.6 | 16.4 | 4.2 | 2.0 | 23.6 | 18.4 | 4.6 | 1.8 | 23.8 |
| (10) | 18.7 | 4.4 | 2.3 | 24.9 | 20.1 | 4.6 | 2.3 | 25.3 | 24.6 | 5.0 | 2.8 | 27.3 |
| (11) | 16.4 | 5.5 | 2.4 | 18.8 | 17.0 | 5.7 | 2.6 | 18.6 | 22.0 | 8.0 | 3.5 | 17.2 |
| Control (1) | 8.2 | 4.0 | 1.9 | 12.1 | 23.8 | 18.2 | 15.6 | 4.6 | 29.5 | 17.1 | 14.6 | 5.0 |

The time of the color change of thymolphthalein in this example represents the time required to reduce the pH of a nonphotosensitive film unit to about pH 10 (normally called "neutralizing time"). The pH 10 is the point where development of silver halide emulsions substantially halts in the photographic chemistry.

According to Table 1, the respective processing sheets of the present invention are found out to have appropriate neutralizing time at each temperature and have sufficient activation energy of alkali permeability, whereas the control processing sheet has shorter neutralizing time particularly at lower temperatures, and its activation energy of penetration by aqueous alkaline solution is extremely low compared to those of the processing sheets of the present invention.

On the other hand, in the preservation tests under the respective conditions, the processing sheets of the present invention showed little change in the neutralizing time and also showed neither extreme rising nor lowering of the activation energy of penetration by aqueous alkaline solution.

In contrast, the control processing sheet showed large change in its neutralizing time at the respective temperatures, and particularly extreme change at lower temperatures. And also it showed extremely low activation energy of penetration by aqueous alkaline solution as compared to those of the untreated sheets.

EXAMPLE 2

The following layers were, in order, coated on a 100μ transparent polyethylene terephthalate support:

(1) Neutralizing layer:

Neutralizing layer with dried thickness of 22μ having acrylic acid-n-butyl acrylate copolymer (average molecular weight 70,000: the ratio by weight 75:25) (22 pmg/100 cm$^2$).

(2) Second timing layer:

Second timing layer with dried thickness of 4.4μ having the mixture (44 mg/100 cm$^2$) of 95% by weight of cellulose diacetate (acetyl content of 40%) with 5% by weight of styrene-maleic anhydride copolymer (hydrolyzed less than 50%) and 5-(2-cyanoethylthio)-1-phenyl tetrazol (1.1 mg/100 cm$^2$).

On the above-mentioned second timing layer, exemplified compounds (1), (6), (9), (10), (14), (15), (22), (23), and the latex as control (n-butyl acrylate-butadiene-acrylic acid: the ratio by weight 80:15:5) synthesized in accordance with the description of Japanese Patent Pre-examined publication No. 53-72622/1978 was coated as shown below to prepare processing sheets.

(3) Timing layer:

Timing layer with dried thickness of 2.2μ containing the above latex (22 mg/100 cm$^2$) and poly(methyl methacrylate beads) (0.22 mg/100 cm$^2$).

The thus prepared processing sheets and the processing sheet as control were regarded as (II-1) to (II-8) and control processing sheet II-1 respectively.

Subsequently, the following layers were, in order, coated on a 100μ transparent polyethylene terephthalate support to prepare a multicolor photosensitive element.

(1) Image receiving layer

The image receiving layer containing gelatin (22 mg/100 cm$^2$) and copoly(styrene-co-N-vinylbenzyl-N-benzyl-N,N-dimethyl ammonium chloride-co-divinylbenzene) (molar ration 49/49/2) (22 mg/100 cm$^2$)

(2) Light reflective layer

The light reflective layer containing titanium dioxide (220 mg/100 cm$^2$) and gelatin (22 mg/100 cm$^2$)

(3) Opaque layer

Opaque layer containing carbon black (27 mg/100 cm$^2$) and gelatin (17 mg/100 cm$^2$)

(4) Cyan dye image forming material layer

Cyan dye image forming material layer containing the cyan dye image forming material (54 mg/100 cm$^2$) having the formula:

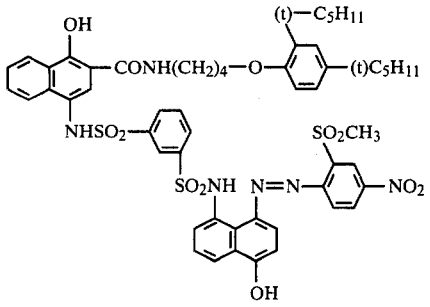

1,4-cyclohexylenedimethylene-bis(2-ethylhexanoate) (2.7 mg/100 cm$^2$) and gelatin (11 mg/100 cm$^2$).

(5) Red-sensitive internal latent image direct-positive silver bromide emulsion layer Red-sensitive silver bromide emulsion layer containing red-sensitive internal latent image direct-positive silver bromide emulsion (11 mg silver/100 cm$^2$. 11 mg gelatin/100 cm$^2$), potassium 2-octyadecylhydroquinone-5-fulfonate (16 g/mol silver), and 1-acetyl-2-{4-[5-amino-2-(2,4-di-t-pentylphenoxy)benzamide]phenyl}-hydrazine (150 mg/mol silver), and 1-p-formyl hydrazinophenyl-3-phenyl-2-thiourea (6 mg/mol silver as a fogging agent).

(6) Interlayer:

Interlayer containing gelatin (11 mg/100 cm$^2$) and 2.5-di-secdodecylhydroquinone (11 mg/100 cm$^2$).

(7) Magenta dye image forming material layer:

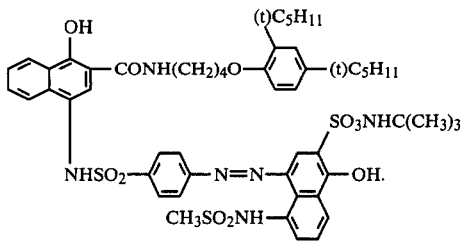

Magenta dye image forming material layer containing a magenta dye image forming material having the above formul (5.4 mg/100 cm$^2$), diethyllauramide (10 mg/100 cm$^2$), and gelatin (20 mg/100 cm$^2$).

(8) Green sensitive internal latent image direct-positive silver bromide emulsion layer:

Green sensitive photosensitive emulsion layer containing a green sensitive internal latent image direct-positive silver bromide emulsion (12.5 mg silver/100 cm$^2$, 13 mg gelatin/100 cm$^2$), potassium-2-octadecylhydroquinone-5-sulfonate (16 g/mol silver), and 1-acetyl-2-{4-[5-amino-2-(2,4-di-t-pentylphenoxy)benzamide]-phenyl}hydrazine (120 mg/mol silver), and 1-formylhydrazinophenyl-3-phenyl-2-thiourea (2.5 mg/mol silver) as a fogging agent.

(9) Interlayer:

Interlayer containing gelatin (16 mg/100 cm$^2$) and 2,5-di-secdodecylhydroquinone (13 mg/100 cm$^2$).

(10) Yellow dye image forming material layer:

Yellow dye image forming material layer containing an yellow dye image forming material (8.6 mg/100 cm$^2$) having the formula:

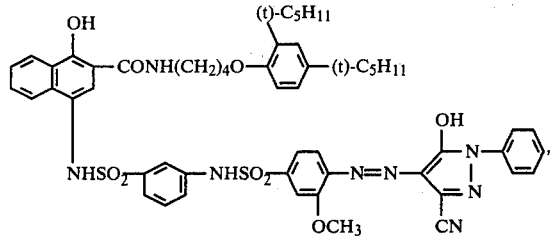

diethyllauramide (4.3 mg/100 cm$^2$) and gelatin (11 mg/100 cm$^2$).

(11) Blue-sensitive internal latent image direct-positive silver bromide emulsion layer:

Blue-sensitive emulsion layer with dried thickness of about 1.5 μm containing a blue-sensitive internal latent image type direct-positive silver bromide emulsion (12.5 mg silver/100 cm$^2$, gelatin 11 mg/100 cm$^2$), 5-sec-octadecyl-5-hydroquinone-2-sulfonate (16 mg/mol silver) and 1-acetyl-2-{4-[5-amino-2-(2,4-di-t-pentylphenoxy)benzamide]phenyl}hydrazine (500 mg/mol silver).

(12) Protective layer:

Protective layer with dried thickness of 0.7 μm containing mucochloric acid (2.0 mg/100 cm$^2$) and gelatin (10 mg/100 cm$^2$).

The film units II-1 to II-8 and the control film unit II-1 were prepared in such manners that exposures were given through a 30-step optical silver wedge with each step difference in density thereof being 1.5 to the thus prepared multicolor photosensitive elements, which were then superposed with the foregoing processing sheets respectively to make photographic materials, between which further was attached pods each containing 1 ml of the composition below. Subsequently, the resulting film units were passed between the juxtaposed pressure rollers with a gap of about 340μ at the temperatures of 15° C. and 25° C. to spread said processing composition between the respective foregoing processing sheets and multicolor photosensitive elements.

The processing composition used here is as follows:

| | |
|---|---|
| Potassium hydroxide | 56 g |
| Sodium sulfite | 2.0 g |
| 1-phenyl-4-hydroxymethyl-4-methyl-3-pyrazolidone | 8.0 g |
| 5-methylbenzotriazol | 2.8 g |
| Carboxy methylcellulose sodium salt | 50 g |
| Carbon black | 150 g |
| Benzyl alcohol | 1.5 ml |
| Distilled water to make | 1 liter |

Several minutes later, a dye image was observed through the transparent support of the multicolor photosensitive element. The reflection densities of the resulting color image were measured through the red (max=644 nm), gree (max=546 nm) and blue (max=434 nm) filters by the use of SAKURA photoelectric densitometer Model PDA-60, manufactured by the Konishiroku Photo Ind. Co., Ltd. The results are shown in Table 2.

As can be seen from Table 2, in the case of using the processing sheets of the present invention, the cyan densities, magenta densities and yellow densities of the dye images and their respective maximum transfer densities (Dmax) obtained at the temperatures of 15° C. and 25° C. were sufficiently high, while their minimum densities (Dmin.) were sufficiently low, thus showing a satisfactory characteristics, and changes in densities between the temperatures were not found.

TABLE 2

| | Red | | | | Green | | | | Blue | | | |
|---|---|---|---|---|---|---|---|---|---|---|---|---|
| | 15° C. | | 25° C. | | 15° C. | | 25° C. | | 15° C. | | 25° C. | |
| | Dmax | Dmin | Dmax | Dmin | Dmax | Dmin | Dmax | Dmin | Dmax | Dmin | Dmax | Dmin |
| Film unit II - 1 | 1.93 | 0.18 | 2.02 | 0.19 | 2.00 | 0.19 | 2.01 | 0.20 | 2.01 | 0.21 | 2.00 | 0.19 |
| II - 2 | 2.13 | 0.24 | 2.16 | 0.20 | 2.06 | 0.20 | 1.99 | 0.18 | 2.15 | 0.20 | 2.14 | 0.20 |
| II - 3 | 1.90 | 0.17 | 1.94 | 0.18 | 2.01 | 0.19 | 2.00 | 0.19 | 1.98 | 0.21 | 2.00 | 0.22 |
| II - 4 | 2.30 | 0.21 | 2.20 | 0.20 | 2.18 | 0.18 | 2.16 | 0.18 | 2.00 | 0.17 | 2.01 | 0.18 |
| II - 5 | 2.06 | 0.20 | 2.08 | 0.18 | 2.02 | 0.19 | 2.02 | 0.19 | 2.04 | 0.20 | 2.05 | 0.19 |
| II - 6 | 2.10 | 0.22 | 2.06 | 0.19 | 2.09 | 0.21 | 2.01 | 0.19 | 2.07 | 0.21 | 2.03 | 0.22 |
| II - 7 | 2.19 | 0.24 | 2.18 | 0.23 | 2.06 | 0.19 | 2.07 | 0.20 | 2.11 | 0.22 | 2.13 | 0.23 |
| II - 8 | 1.96 | 0.18 | 2.06 | 0.22 | 2.00 | 0.20 | 2.02 | 0.21 | 2.01 | 0.18 | 2.00 | 0.20 |
| Control Film Unit II - 1 | 1.42 | 0.16 | 2.16 | 0.22 | 1.53 | 0.17 | 2.01 | 0.24 | 1.30 | 0.15 | 1.90 | 0.18 |

On the other hand, the results of the use of the control processing sheet show extremely low maximum transfer density at the temperature of 15° C. (lower temperature), and also show noticeable changes in the maximum transfer densities between the temperatures.

EXAMPLE 3

The processing sheets II-4, II-5, II-7, II-10, II-11 and the control processing sheet II-1 employed in Example 2 were treated over the period of three days at 55° C., and over the period of three days at 50° C. with the relative humidity of 80%, and these sheets were regarded as processing sheets III-1 to III-5 and control processing sheet III-1 respectively.

Next, the multicolor photosensitive element used in Example 2 was exposed to light in the same condition, and was then superposed with each of the above-mentioned processing sheets between which a pod containing 1 ml of the same processing composition as in Example 1 was attached to pr-pare film units III-1 to III-5 and control film unit III-1.

Then, the above film units were passed between the juxtaposed pressure rollers with a gap of about 340μ at the temperatures of 25° C. and 35° C. to spread the processing composition between the foregoing processing sheet and the multicolor photosensitive element of each of the units.

TABLE 3

| Red | | | | | | | | |
|---|---|---|---|---|---|---|---|---|
| | 55° C. 3 days | | | | 50° C. 80% 3 days | | | |
| Processing | 25° C. | | 35° C. | | 25° C. | | 35° C. | |
| Sheet | Dmax | Dmin | Dmax | Dmin | Dmax | Dmin | Dmax | Dmin |
| III - 1 | 2.06 | 0.22 | 2.00 | 0.20 | 2.04 | 0.23 | 2.03 | 0.22 |
| III - 2 | 1.98 | 0.18 | 2.00 | 0.19 | 1.99 | 0.20 | 2.00 | 0.20 |
| III - 3 | 2.13 | 0.22 | 2.16 | 0.24 | 2.16 | 0.24 | 2.06 | 0.19 |
| III - 4 | 2.16 | 0.19 | 2.06 | 0.20 | 1.96 | 0.18 | 2.00 | 0.20 |
| III - 5 | 2.06 | 0.18 | 1.99 | 0.16 | 2.03 | 0.20 | 1.98 | 0.18 |
| Control III - 1 | 2.18 | 1.67 | 2.23 | 2.06 | 2.16 | 1.87 | 1.98 | 1.88 |

| Green | | | | | | | | |
|---|---|---|---|---|---|---|---|---|
| | 55° C. 3 days | | | | 50° C. 80% 3 days | | | |
| Processing | 25° C. | | 35° C. | | 25° C. | | 35° C. | |
| Sheet | Dmax | Dmin | Dmax | Dmin | Dmax | Dmin | Dmax | Dmin |
| III - 1 | 2.03 | 0.16 | 2.00 | 0.15 | 2.13 | 0.20 | 2.16 | 0.24 |
| III - 2 | 1.91 | 0.16 | 1.98 | 0.18 | 1.99 | 0.21 | 1.98 | 0.21 |
| III - 3 | 1.98 | 0.20 | 2.00 | 0.22 | 1.99 | 0.20 | 2.03 | 0.24 |
| III - 4 | 2.16 | 0.24 | 2.13 | 0.23 | 1.90 | 0.21 | 2.06 | 0.20 |
| III - 5 | 2.02 | 0.18 | 2.04 | 0.20 | 1.96 | 0.21 | 1.98 | 0.18 |
| Control III - 1 | 2.03 | 2.00 | 2.16 | 1.98 | 1.98 | 1.73 | 1.98 | 1.70 |

| Blue | | | | | | | | |
|---|---|---|---|---|---|---|---|---|
| | 55° C. 3 days | | | | 50° C. 80% 3 days | | | |
| Processing | 25° C. | | 35° C. | | 25° C. | | 35° C. | |
| Sheet | Dmax | Dmin | Dmax | Dmin | Dmax | Dmin | Dmax | Dmin |
| III - 1 | 2.18 | 0.24 | 2.16 | 0.22 | 2.13 | 0.20 | 2.00 | 0.21 |
| III - 2 | 2.01 | 0.20 | 2.03 | 0.21 | 2.11 | 0.23 | 2.14 | 0.21 |
| III - 3 | 1.95 | 0.16 | 1.98 | 0.20 | 1.97 | 0.21 | 2.00 | 0.24 |
| III - 4 | 2.06 | 0.22 | 2.05 | 0.23 | 2.08 | 0.24 | 2.11 | 0.24 |
| III - 5 | 1.86 | 0.15 | 1.88 | 0.23 | 1.92 | 0.18 | 1.96 | 0.20 |
| Control III - 1 | 1.87 | 1.65 | 1.88 | 1.65 | 2.08 | 2.05 | 2.00 | 1.96 |

Several minutes later, a dye image was observed through the transparent support of the multicolor photosensitive element. Measurements were made on the reflection densities of the resulting dye images through the red (max=644 nm), green (max=546 nm) and blue (max=434 nm) filters by use of SAKURA photoelectric densitometer Model PDA-60, manufactured by the Konishiroku Photo Ind. Co., Ltd. The results are shown in Table 3.

Table 3 shows that in the case of treating the processing sheets of the present invention at the temperature of 55° C. with the humidity of 80% for three days, the maximum transfer densities (Dmax) are high, while the minimum transfer densities (Dmin) are low, and changes in the densities between the temperatures of 25° C. and 35° C. are small.

On the other hand, it is found that the control processing sheet has extremely high fog at both temperatures.

EXAMPLE 4

The following layers were coated, in order, on a 100μ transparent polyethylene terephthalate support to prepare monochromatic photosensitive elements:

(1) Image receiving layer:

Image receiving layer with dried thickness of 4.4μ containing poly(divinylbenzene-co-styrene-co-N-benzyl-N,N-dimethyl-N-vinylbenzyl ammonium chloride) (molar ratio 2:49:49) (22 mg/100 cm$^2$).

(2) Light reflective layer:

Light reflective layer with dried thickness of 7 to 8μ containing titanium dioxide (220 mg/100 cm$^2$) and gelatin (22 mg/100 cm$^2$).

(3) Opaque layer:

Opaque layer with dried thickness of 4μ containing carbon black (28 mg/100 cm$^2$) and gelatin (18 mg/100 cm$^2$).

(4) Layer containing red-sensitive negative type silver bromide emulsion (10.5 mg silver/100 cm$^2$, 22 mg gelatin/100 cm$^2$) and non-diffusible cyan dye image forming material (4.7 mg/100 cm$^2$) having the formula:

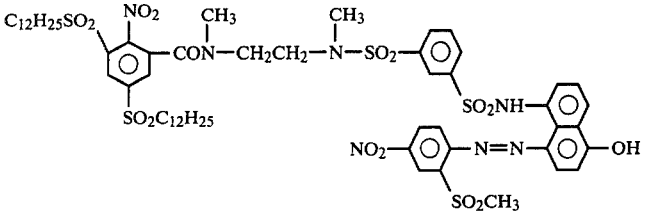

and electron providing material (7.0 mg/100 cm$^2$) having the formula:

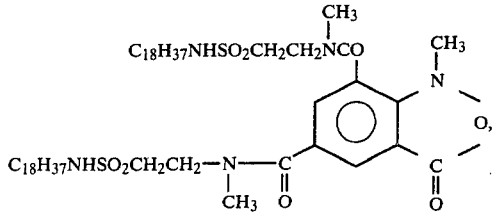

and N,N-diethyllauramide (11.7 mg/100 cm$^2$).

(5) Protective layer:

Protective layer containing gelatin (10 mg/100 cm$^2$) and mucochloric acid (1.2 mg/100 cm$^2$).

Film units VI-1 to VI-3 and control film unit VI-1 were prepared in such manners that exposures similar to those in Example 2 were given to the thus prepared monochromatic photosensitive elements, which were then superposed with the processing sheets III-1, III-4, III-5 and control sheet III-1 used in Example 3 respectively, between which elements and sheets were attached pods each containing 1 ml of the processing composition shown below. The above film units were then passed between the juxtaposed pressure roller with a gap of about 340μ at the temperatures of 15° C. and 25° C. to rupture the pod to spread the composition between said monochromatic photosensitive element and said processing sheet of each of the units.

The processing compositions used here are as follows:

| | |
|---|---|
| Potassium hydroxide | 70 g |
| 5-methyl-benzotriazol | 1 g |
| 1-phenyl-4-hydroxymethyl-4-methyl-3-pyrazolidone | 5 g |
| Potassium bromide | 20 g |
| Carboxymethylcellulose sodium salt | 50 g |
| Carbon black | 150 g |
| Distilled water to make | 1,000 ml |

Several minutes later, a cyan dye image was observed through the transparent support of the photosensitive element. The reflection densities of the resulting dye image were measured through a red filter (max=644 nm) by use of SAKURA photoelectric densitometer Model PDA-60, manufactured by the Konishiroku Photo Ind. Co., Ltd.

TABLE 4

| | Red | | | |
|---|---|---|---|---|
| | 15 C. | | 25 C. | |
| | Dmax | Dmin | Dmax | Dmin |
| Film unit VI - 1 | 2.13 | 0.22 | 2.16 | 0.23 |
| Film unit VI - 2 | 1.03 | 0.18 | 0.96 | 0.16 |
| Film unit VI - 3 | 2.06 | 0.20 | 2.04 | 0.18 |
| Film unit VI - 4 | 2.09 | 0.23 | 2.05 | 0.21 |
| Control VI - 1 | 2.03 | 0.21 | 1.99 | 0.20 |

Table 4 shows that, in the processing sheet of the present invention, the maximum cyan transfer densities (Dmax) at the respective temperatures of 15° C. and 25° C. are sufficiently high, while the minimum transfer densities (Dmin) are sufficiently low, and changes in the densities between both the temperatures are small.

On the other hand, the control processing sheet's maximum transfer densities at both 15° C. and 25° C. are extremely low and thus considered unsatisfactory for practical use.

What is claimed is:

1. A photographic element for color diffusion transfer process comprising a support and thereon, as essential layers, a neutralizing layer and a timing layer in this order, wherein said timing layer comprises a polymeric latex represented by the general formula [I];

$$+A+_x+B+_y+C+_z \quad [I]$$

wherein A represents a copolymerizable conjugated diene monomer unit, B represents a copolymerizable ethylenically unsaturated acid monomer unit or a salt thereof, C represents a copolymerizable ethylenically unsaturated monomer unit, x, y and z individually represent a portion contained in said polymeric latex in terms of percentage by weight, and x is from about 55 to about 99.5%, y is from about 0.5 to about 44.5%, and z is from zero to about 44.5%.

2. A photographic element according to claim 1 wherein said monomer unit A is represented by the formula [II];

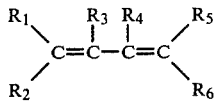

[II]

wherein $R_1$ to $R_6$ independently represent a hydrogen atom or a halogen atom, or an alkyl, aryl, cyano, or —$COOR_7$ group wherein $R_7$ is an alkyl group.

3. A photographic element according to claim 2 wherein $R_1$ to $R_6$ are independently selected from the group consisting of a hydrogen atom, a halogen atom, and an alkyl group.

4. A photographic element according to claim 2 wherein $R_1$ to $R_6$ are independently a hydrogen atom or an alkyl group having 1 to 4 carbon atoms.

5. A photographic element according to claim 2 wherein A is isoprene or 2,3-dimethyl-1,3-butadiene.

6. A photographic element according to claim 1 wherein said monomer unit B is represented by the formula [III];

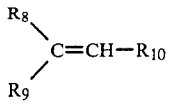

[III]

wherein $R_8$ is a carboxyl or sulfo group, or an alkali metallic salt thereof, a group containing therein a carboxyl group or sulfo group or a alkali metallic salt thereof, $R_9$ is a hydrogen atom or an alkyl group, and $R_{10}$ is a hydrogen atom or an alkoxycarbonyl group.

7. A photographic element according to claim 6 wherein said monomer unit B is acrylic acid.

8. A photographic element according to claim 1 wherein said monomer unit C is selected from the group consisting of copolymerizable ethylenic nitriles, styrenes, acrylic acid esters, and methacrylic acid esters.

9. A photographic element according to claim 8 wherein said monomer unit C is acrylonitrile.

10. A photographic element according to claim 1 wherein the photographic element further comprises a second timing layer.

11. A photographic element according to claim 1 wherein x is from about 60 to about 80%, y is from about 2 to about 8%, and z is from about 15 to about 40%.

* * * * *